US008317481B2

(12) United States Patent
Martin et al.

(10) Patent No.: US 8,317,481 B2
(45) Date of Patent: Nov. 27, 2012

(54) ROTOR OF A TURBOMACHINE AND METHOD FOR REPLACING ROTOR BLADES OF THE ROTOR

(75) Inventors: Nick Martin, Simpsonville, SC (US); John Raymond Hess, Seneca, SC (US)

(73) Assignee: General Electric Company, Schenectady, NY (US)

( * ) Notice: Subject to any disclaimer, the term of this patent is extended or adjusted under 35 U.S.C. 154(b) by 1315 days.

(21) Appl. No.: 12/035,922

(22) Filed: Feb. 22, 2008

(65) Prior Publication Data

US 2009/0214350 A1 Aug. 27, 2009

(51) Int. Cl.
*F01D 5/30* (2006.01)

(52) U.S. Cl. ..... 416/220 R; 29/402.08; 29/889.1

(58) Field of Classification Search ..... 29/889.21; 416/220 R, 219 R, 198 R, 198 A, 248, 244 A, 416/62

See application file for complete search history.

(56) References Cited

U.S. PATENT DOCUMENTS

| | | | | |
|---|---|---|---|---|
| 3,165,294 | A * | 1/1965 | Anderson | 416/220 R |
| 4,400,137 | A * | 8/1983 | Miller et al. | 416/220 R |
| 4,451,205 | A * | 5/1984 | Honda et al. | 416/219 R |
| 4,890,981 | A * | 1/1990 | Corsmeier et al. | 416/220 R |
| 4,915,587 | A * | 4/1990 | Pisz et al. | 416/220 R |
| 5,318,405 | A * | 6/1994 | Meade et al. | 416/220 R |
| 5,713,721 | A * | 2/1998 | Glynn et al. | 416/220 R |
| 6,619,924 | B2 * | 9/2003 | Miller | 416/220 R |
| 7,267,527 | B2 | 9/2007 | Fischer et al. | |
| 2006/0018756 | A1 * | 1/2006 | Schroder | 416/219 R |
| 2006/0188374 | A1 * | 8/2006 | Mickol et al. | 416/219 R |
| 2007/0065287 | A1 * | 3/2007 | Suciu et al. | 416/198 R |

* cited by examiner

*Primary Examiner* — Edward Look
*Assistant Examiner* — Jason Davis
(74) *Attorney, Agent, or Firm* — Cantor Colburn LLP

(57) ABSTRACT

A rotor of a turbomachine is provided. The rotor includes at least first and second rotor portions and at least first and second blades. The first and second rotor portions are configured to rotate about an axis. The first and second rotor portions have first and second rim portions, respectively, which are spaced a predetermined distance apart from one another and have a perimetrical slot therebetween. The first and second rim portions have first and second dovetail slots, respectively, extending therethrough communicating with the perimetrical slot. The first and second blades have first and second dovetail portions, respectively. The first dovetail portion is disposed in one of the first and second dovetail slots, and the second dovetail portion is disposed in the other of the first and second dovetail slots. The perimetrical slot has a sufficient size to pass the first and second blades therethrough when the first and second blades are removed from the rotor.

12 Claims, 7 Drawing Sheets

ROTOR OF A TURBOMACHINE AND METHOD FOR REPLACING ROTOR BLADES OF THE ROTOR

BACKGROUND OF THE INVENTION

Gas turbines have rotors with rotor blades that may degrade over time. Further, repairing the rotor blades requires complete disassembly of the rotor which can take a significant amount of time to complete. In some cases, repairing the rotor blades can require four to six weeks of work. For regularly used gas turbines, such a long downtime is notably undesirable.

Accordingly, the inventors herein have recognized a need for an improved rotor and a method for replacing rotor blades of the rotor.

BRIEF DESCRIPTION OF THE INVENTION

A rotor of a turbomachine in accordance with an exemplary embodiment is provided. The rotor includes at least first and second rotor portions and at least first and second blades. The first and second rotor portions are configured to rotate about an axis. The first and second rotor portions have first and second rim portions, respectively, which are spaced a predetermined distance apart from one another and have a perimetrical slot therebetween. The first and second rim portions have first and second dovetail slots, respectively, extending therethrough communicating with the perimetrical slot. The first and second blades have first and second dovetail portions, respectively. The first dovetail portion is disposed in one of the first and second dovetail slots, and the second dovetail portion is disposed in the other of the first and second dovetail slots. The perimetrical slot has a sufficient size to pass the first and second blades therethrough when the first and second blades are removed from the rotor.

A method for replacing a rotor blade of a rotor in accordance with another exemplary embodiment is provided. The method includes moving a first dovetail portion of a first blade from one of a first dovetail slot and a second dovetail slot of first and second rim portions, respectively, through a perimetrical slot and away from the rotor such that the first blade is removed from the rotor. The perimetrical slot disposed between the first and second rim portions and communicating with the first and second dovetail slots. The method further includes moving a first replacement dovetail portion of a first replacement blade through the perimetrical slot toward one of the first and second rim portions such that the first replacement dovetail portion is received in one of the first and second dovetail slots.

DETAILED DESCRIPTION OF THE INVENTION

The present application is directed to a rotor of a turbomachine and a method for replacing a rotor blade on the rotor without removing the entire rotor from the turbomachine and disassembling the entire rotor. In these embodiments, the rotor is a component of a compressor of a gas turbine. However, it is contemplated that the rotor can be other suitable components of a variety of turbomachines. In addition, it is further contemplated that the blades can be replaced on the rotor after the rotor has been removed from the turbomachine and disassembled.

Figure 1:
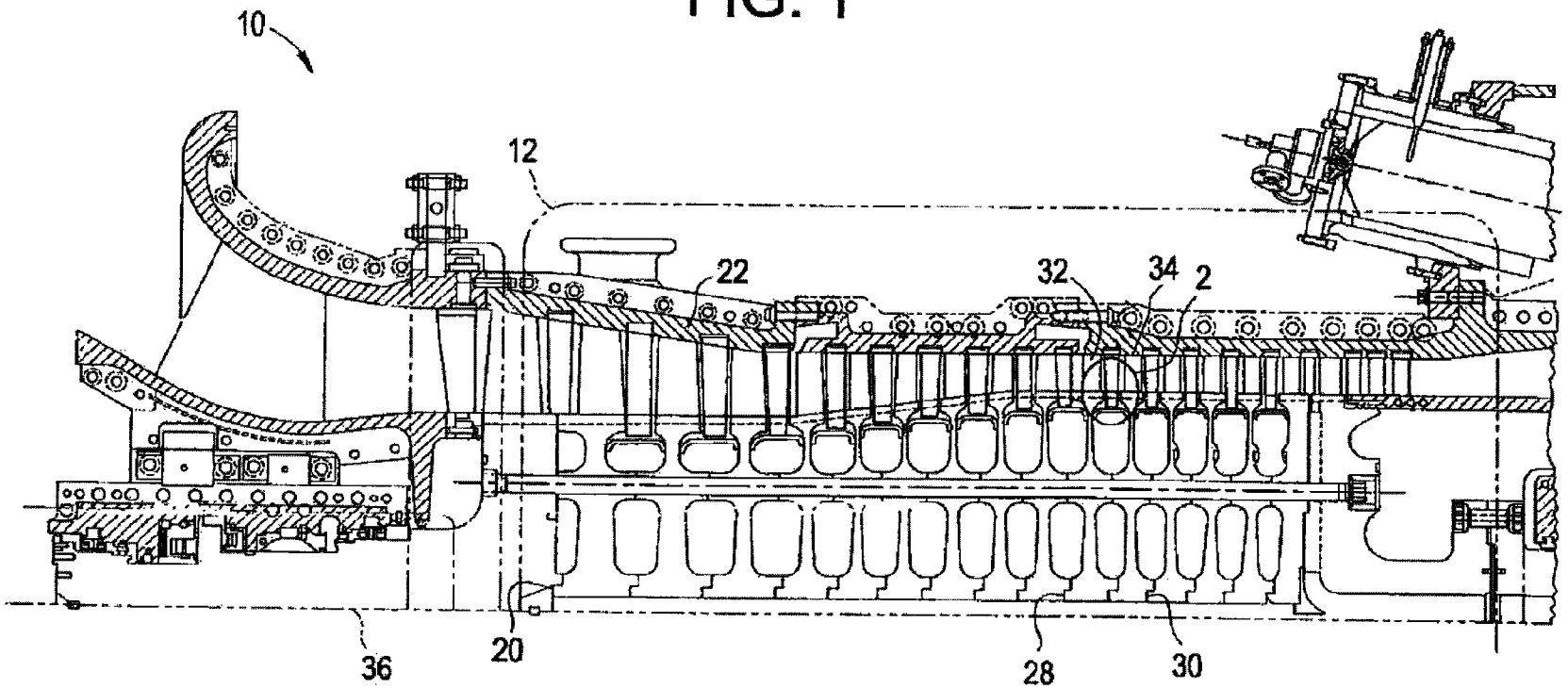
FIG. 1 is a cross-sectional schematic of a portion of a gas turbine having a compressor portion with a rotor, in accordance with an exemplary embodiment.
Figure 2:
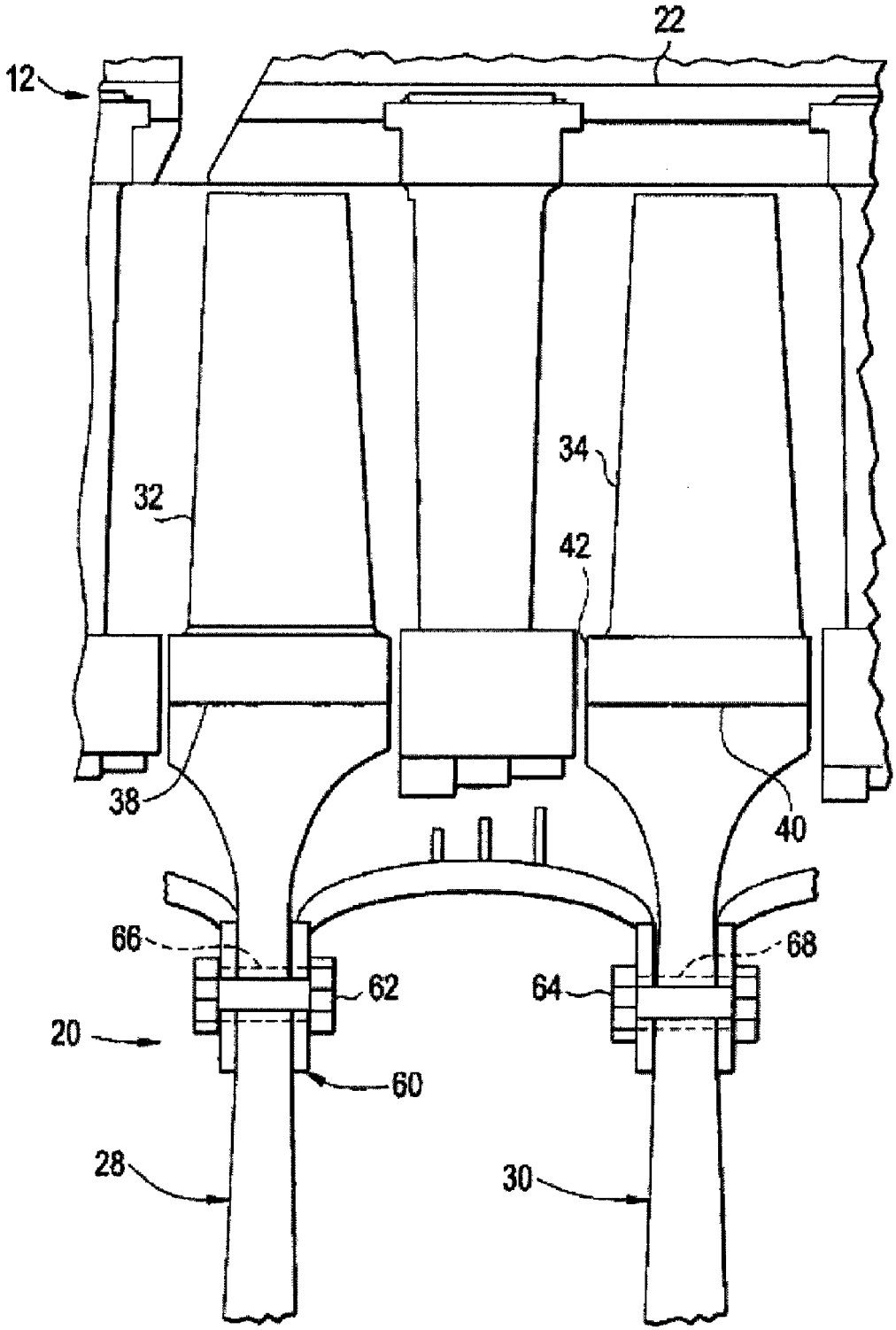
FIG. 2 is an enlarged cross-sectional schematic of the compressor portion utilized in the gas turbine of FIG. 1, as taken from within the circle designated by reference numeral 2.
Figure 3:
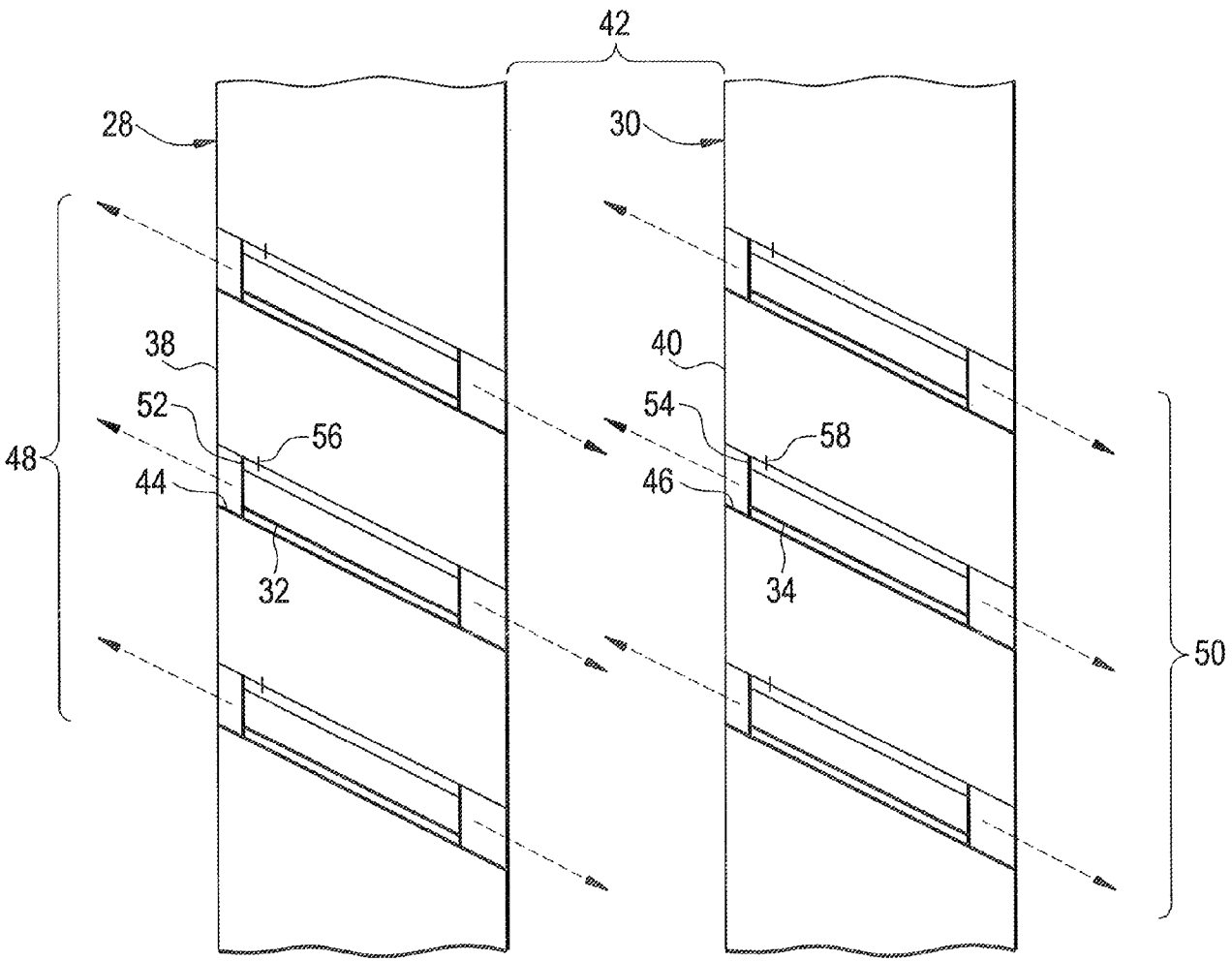
FIG. 3 is schematic of two adjacent rotor portions of a rotor utilized in the gas turbine of FIG. 1.

Referring to FIGS. 1-3, a turbomachine such as a gas turbine 10 having a compressor portion 12 with a rotor 20 in accordance with an exemplary embodiment is provided. The rotor 20 is configured to rotate within a housing 22 of the gas turbine 10. The rotor 20 has at least first and second rotor portions 28, 30 and at least first and second blades 32, 34. In particular, the first and second rotor portions 28, 30 are configured to rotate about an axis 36 within the housing 22. The first and second rotor portions 28, 30 have first and second rim portions 38, 40, respectively, which are spaced a predetermined distance apart from one another and have a perimetrical slot 42 therebetween. The first and second rim portions 38, 40 have first and second dovetail slots 44, 46, respectively, extending therethrough communicating with the perimetrical slot 42. The perimetrical slot 42 has a sufficient size to pass the first and second blades 32, 34 therethrough when the first and second blades 32, 34 are removed from the first and second rotor portions 28, 30.

Figure 4:
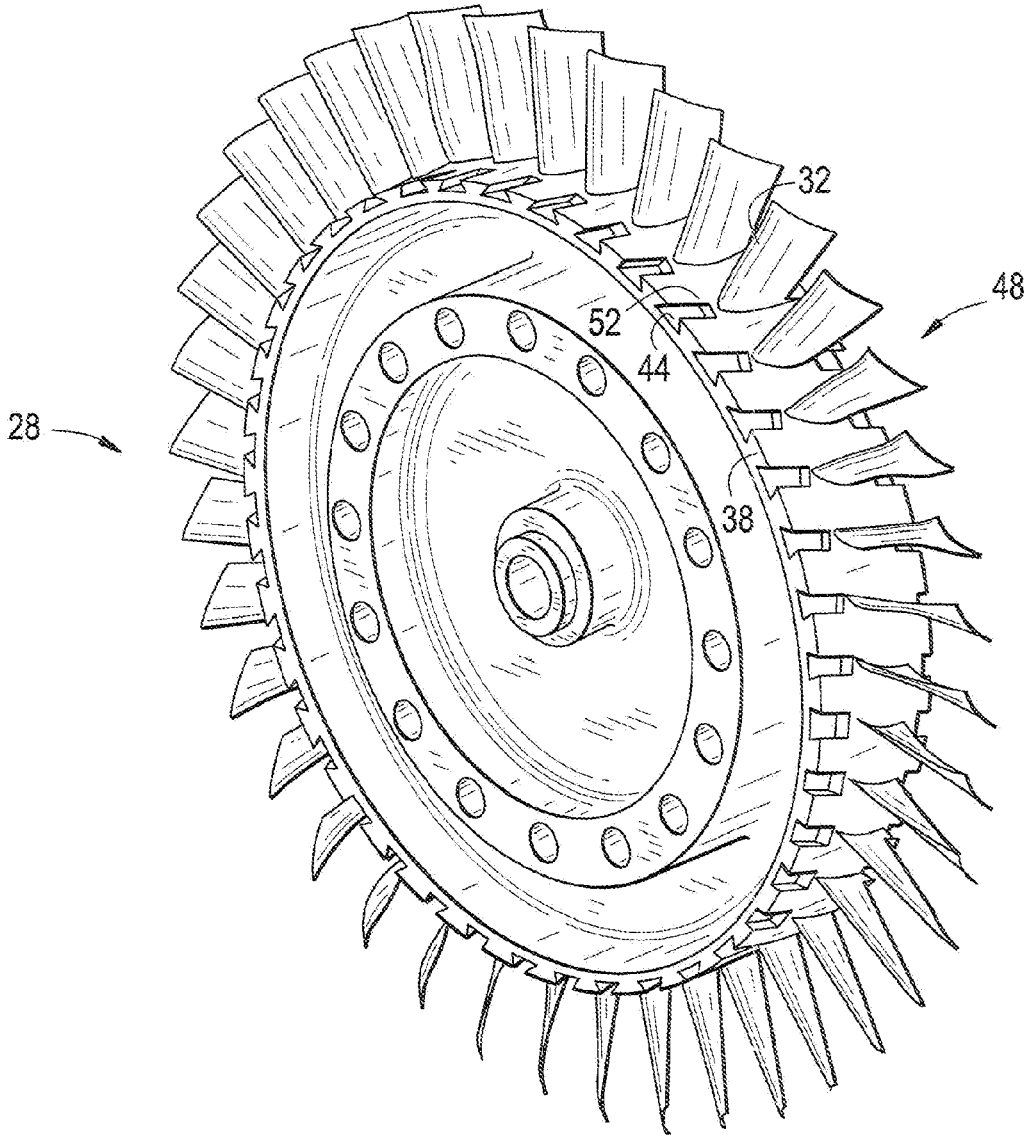
FIG. 4 is a perspective schematic of one of the rotor portions of the rotor utilized in the gas turbine of FIG. 1.
Figure 5:
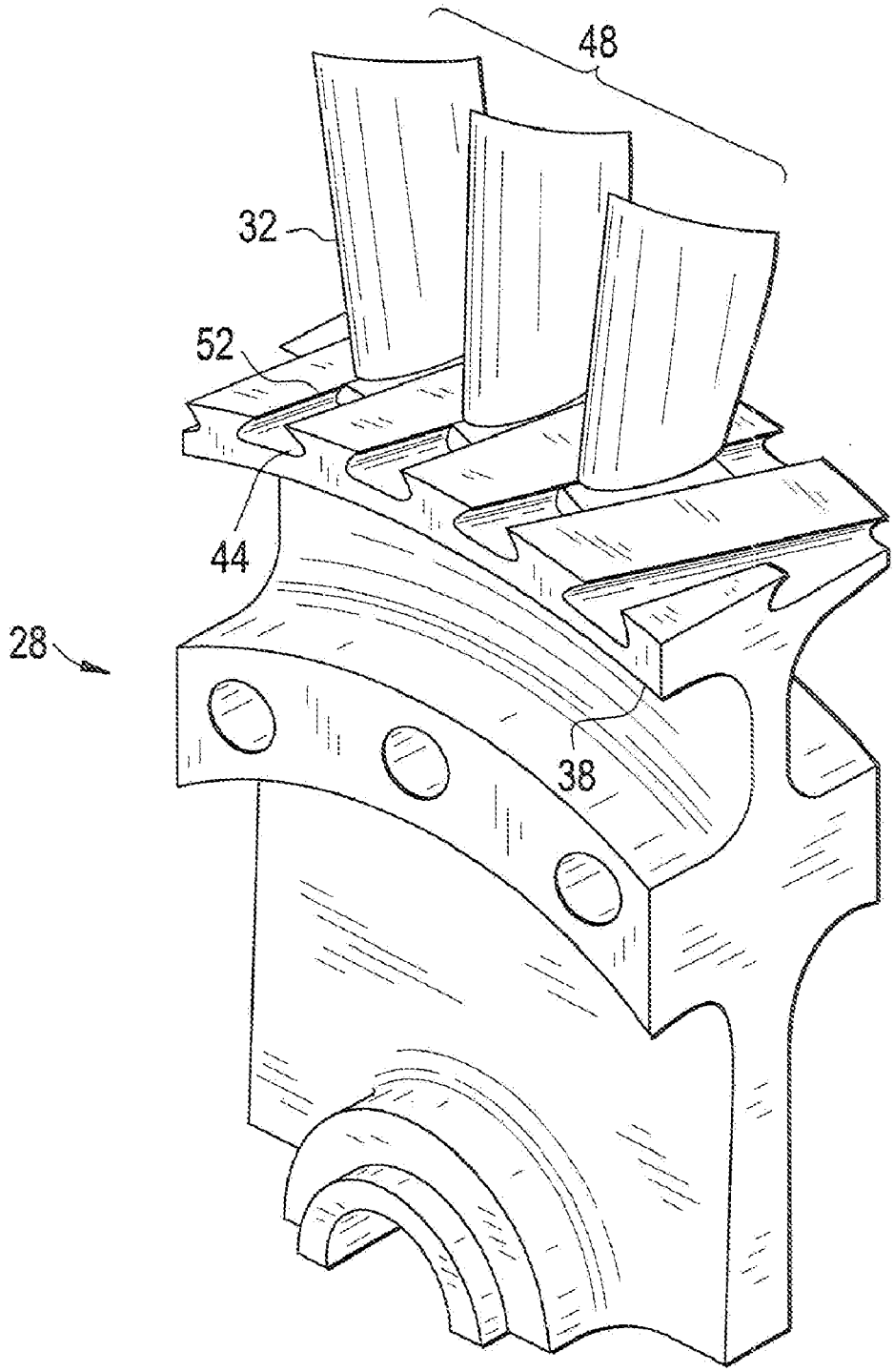
FIG. 5 is an enlarged cutaway schematic of the rotor portion of FIG. 4.

Referring to FIGS. 3-5, the first rotor portion 28 has a first stage of blades 48 including the first blade 32. Similarly, the second rotor portion 30 has a second stage of blades 50 including the second blade 34. Each blade in the first stage of blades 48 is substantially similar to the first blade 32, and each blade in the second stage of blades is substantially similar to the second blade 34. Accordingly, only first and second blades 32, 34 will be discussed in detail below. However, it is contemplated that the blades in each stage can be different from each other.

The first and second blades 32, 34 have first and second dovetail portions 52, 54, respectively. The first dovetail portion 52 is configured to be received in one of the first and second dovetail slots 44, 46. Further, the second dovetail portion 54 is configured to be received in the other of the first and second dovetail slots 44, 46. In this non-limiting embodiment, the first blade 32 is coupled to the first rotor portion 28 by moving the first blade 32 through the perimetrical slot 42 toward the first rim portion 38 such that the first dovetail portion 52 is disposed or received in the first dovetail slot 44. The second blade 34 is coupled to the second rotor portion 30 by moving the second blade 34 through the perimetrical slot 42 toward the second rim portion 40 such that the second dovetail portion 54 is disposed or received in the second dovetail slot 46. It is contemplated that the first blade 32 can be coupled to the second rotor portion 30 rather than the first rotor portion 28, and the second blade 34 can be coupled to the first rotor portion 28 rather than the second rotor portion 30.

Referring to FIG. 3, the rotor 20 further includes at least first and second axial retention fasteners 56, 58 configured to fixedly hold the first and second dovetail portions 52, 54 of the first and second blades 32, 34, respectively, to the first and second rim portions 38, 40 of the first and second rotor portions 28, 30. One non-limiting example of the first and second axial retention fasteners is a deformation of at least a portion of the first and second rim portions 38, 40 in order to crimp the first and second rim portions 38, 40 onto the first and second dovetail portions 52, 54 in the first and second dovetail slots 44, 46.

The first blade 32 is decoupled from the first rotor portion 28 by removing the first axial retention fastener 56 from the first rim portion 38 and the first dovetail portion 52 of the first blade 32, and then moving the first blade 32 from the first rim portion 38 through the perimetrical slot 42 and away from the rotor 20. Likewise, the second blade 34 is decoupled from the second rotor portion 30 by removing the second axial retention fastener 58 from the second rim portion 40 and the second dovetail portion 54 of the second blade 34, and then moving the second blade 34 from the second rim portion 40 through the perimetrical slot 42 and away from the rotor 20.

First and second replacement blades can be moved through the perimetrical slot 42 toward the first and second rim portions 38, 40, such that a first replacement dovetail portion of the first replacement blade is received within one of the first and second dovetail slots 44, 46 and a second replacement dovetail portion of the second replacement blade is received within the other of the first and second dovetail slots 44, 46. First and second replacement axial retention fasteners can then be attached to the first and second replacement dovetail portions for fixedly holding the first and second replacement blades to the rotor. Accordingly, the first and second blades 32, 34 can be replaced without removing the rotor 20 from the gas turbine and disassembling the rotor 20.

It is contemplated that blades on the outermost forward and aft rotor portions can be moved forward and aft from the outermost forward and aft rotor portions, respectively, such that the blades are removed from the rotor without the blades passing through the perimetrical slots in the rotor. Similarly, replacement blades can be moved aft and forward toward the outermost forward and aft rotor portions, respectively, for attaching the replacement blades to the outermost forward and aft rotor portions without the replacement blades passing through the perimetrical slots in the rotor.

Referring to FIG. 2, the rotor 20 further includes an annular seal 60 extending between the first and second rotor portions 28, 30. The annular seal 60 is a metal hoop fixedly attached to the first and second rotor portions 28, 30 by a pair of fasteners 62, 64 that are received within a pair of holes 66, 68 extending through the first and second rotor portions 28, 30, respectively. It is contemplated that the annular seal 60 can be fixedly attached to the first and second rotor portions 28, 30, utilizing more or less than two fasteners 62, 64.

Figure 6:
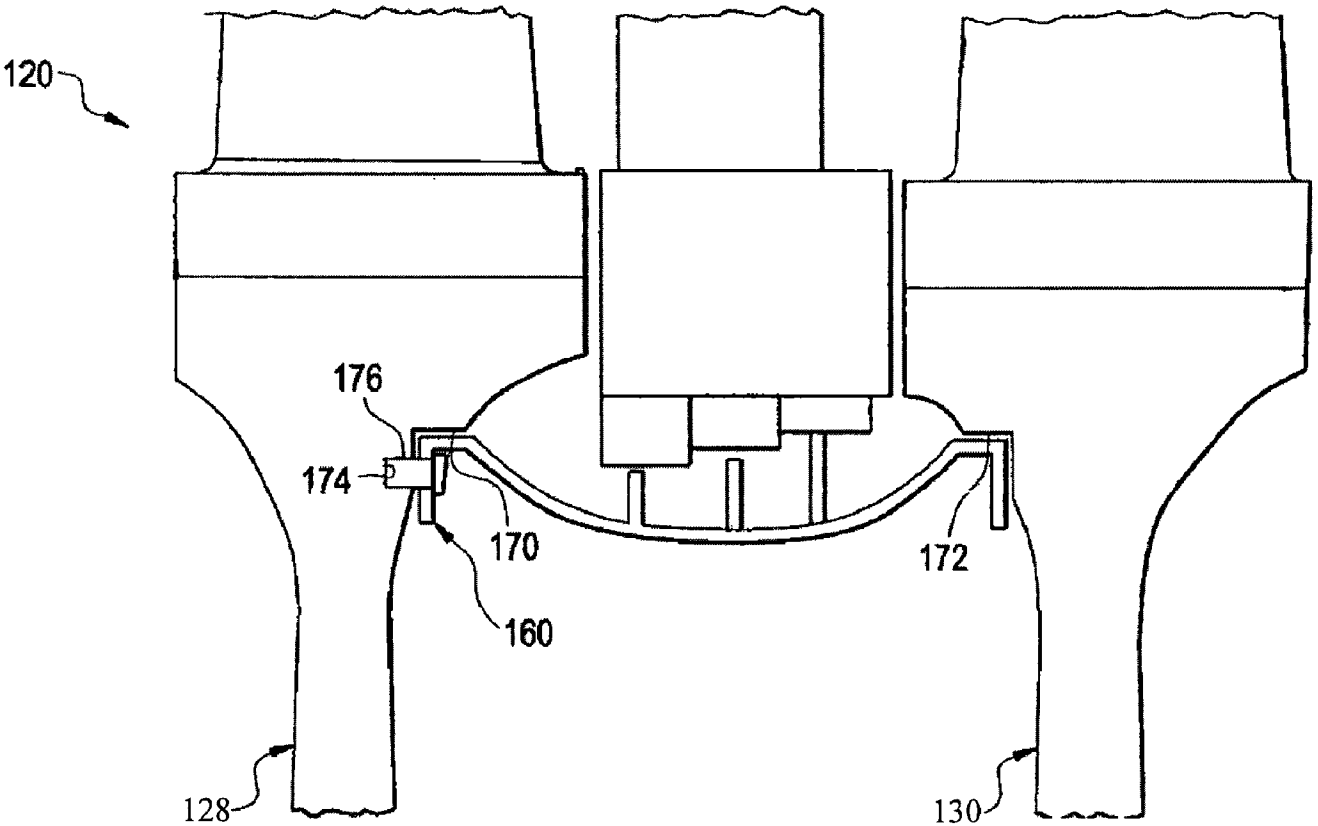
FIG. 6 is an enlarged cross-sectional schematic of a portion of the rotor utilized in the gas turbine of FIG. 1.

Referring to FIG. 6, a rotor 120 in accordance with another exemplary embodiment is provided. The rotor 120 having an annular seal 160 and first and second rotor portions 128, 130, is substantially similar to the rotor 20 of FIG. 3 respectively having the annular seal 60 and first and second rotor portions 28, 30. However, the first and second rotor portions 128, 130 have first and second annular notches 170, 172 configured to receive the annular seal 160. In addition, the first rotor portion 128 has an aperture 174 configured to receive an anti-rotational detent member 176 extending from the annular seal 160, causing synchronous rotation of the first rotor portion 128 and the annular seal 160. It is contemplated that the second rotor portion 130 can also have an aperture for receiving an anti-rotational detent member extending from the annular seal.

Figure 7:
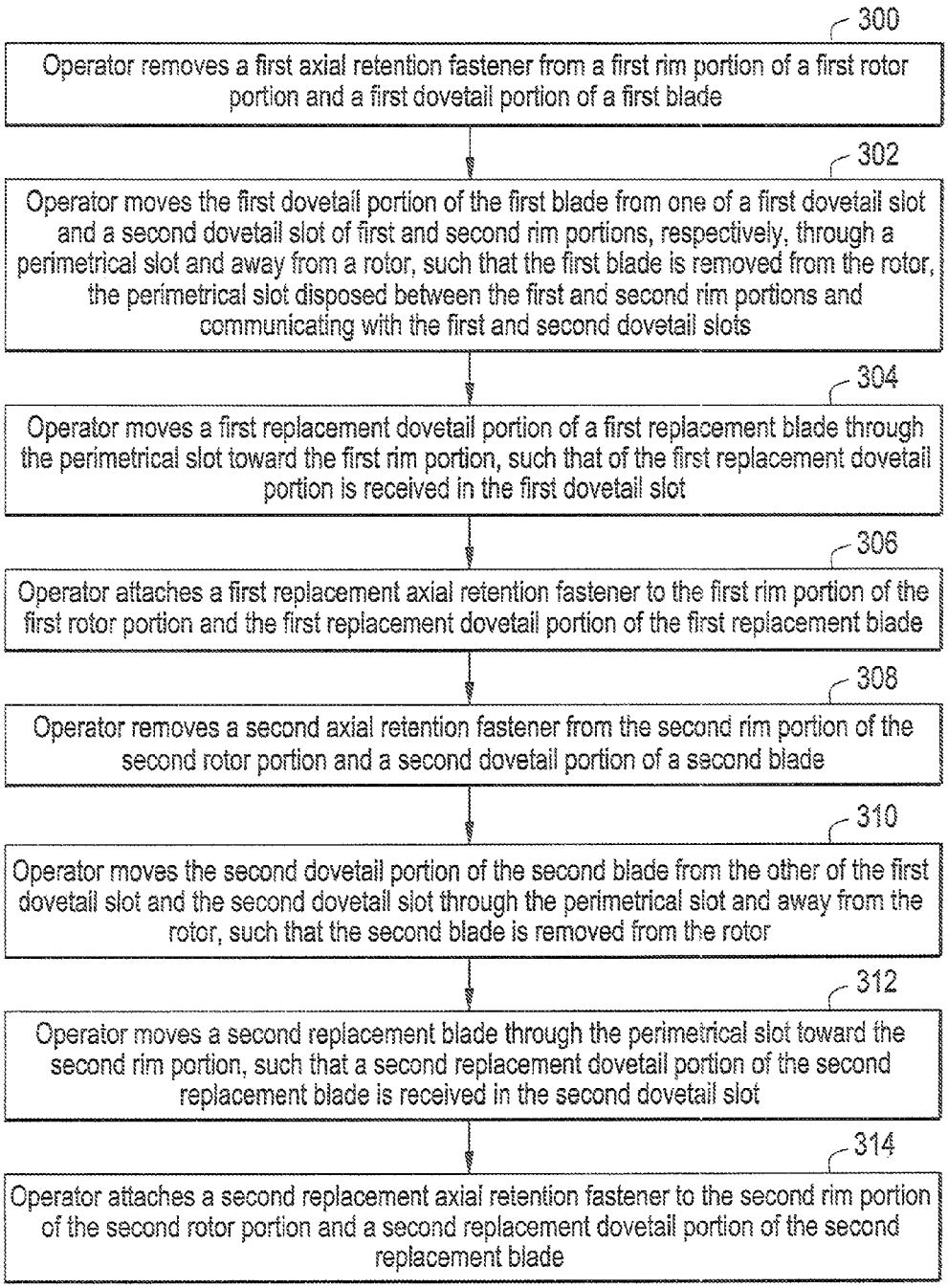
FIG. 7 is a flowchart of a method for replacing a rotor blade of a rotor of a gas turbine, in accordance with another exemplary embodiment.

Referring to FIG. 7, a method for replacing a rotor blade of the rotor 20 of FIGS. 1 through 5 will now be explained. The rotor 20 is configured to allow one or more rotor blades to be replaced without removing the entire rotor 20 from the gas turbine 10 and disassembling the rotor 20. Although the explanation below discusses how two or more blades can be consecutively replaced one after the other, it is contemplated that two or more blades can be simultaneously replaced as desired.

At step 300, an operator removes the first axial retention fastener 56 from the first rim portion 38 of the first rotor portion 28 and the first dovetail portion 52 of the first blade 32.

Next at step 302, the operator moves the first dovetail portion 52 of the first blade 32 from the first dovetail slot 44 of the first rim portion 38 through the perimetrical slot 42 and away from the rotor 20, such that the first blade 32 is removed from the rotor 20.

Next at step 304, the operator moves a first replacement blade through the perimetrical slot 42 toward the first rim portion 38, such that the first replacement dovetail portion of the first replacement blade is received in the first dovetail slot 44.

Next at step 306, the operator attaches a first replacement axial retention fastener to the first rim portion 38 of the first rotor portion 28 and the first replacement dovetail portion of the first replacement blade.

Next at step 308, the operator removes the second axial retention fastener 58 from the second rim portion 40 of the second rotor portion 30 and the second dovetail portion 54 of the second blade 34.

Next at step 310, the operator moves the second dovetail portion 54 of the second blade 34 from the second dovetail slot 46 of the second rim portion 40 through the perimetrical slot 42 and away from the rotor 20, such that the second blade 34 is removed from the rotor 20.

Next at step 312, the operator moves a second replacement blade through the perimetrical slot 42 toward the second rim portion 40, such that the second replacement dovetail portion of the second replacement blade is received in the second dovetail slot 46.

Next at step 314, the operator attaches a second replacement axial retention fastener to the second rim portion 40 of the second rotor portion 30 and the second replacement dovetail portion of the second replacement blade.

The rotor and methods described herein provide a substantial advantage over other devices and methods. In particular, the rotor provides a technical effect of replacing rotor blades without removing the rotor from a gas turbine and disassembling the rotor.

While the invention has been described with reference to an exemplary embodiment, various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed herein, but that the invention will include all embodiments falling within the scope of the appended claims.

We claim:

1. A rotor for a turbomachine, comprising:

at least first and second rotor portions configured to rotate about an axis, the first and second rotor portions having first and second rim portions, respectively, which are spaced a predetermined distance apart from one another and have a perimetrical slot therebetween, the first and second rim portions having first and second dovetail slots defined therein, respectively, to extend therethrough to communicate with the perimetrical slot and the first and second rim portions having respective lengths that are substantially similar to respective widths of the at least first and second rotor portions, respectively;

at least first and second blades having first and second dovetail portions, respectively, the first dovetail portion disposed in one of the first and second dovetail slots, the second dovetail portion disposed in the other of the first and second dovetail slots, wherein the perimetrical slot has a sufficient size to pass the first and second dovetail portions therethrough when the first and second blades are removed from the rotor; and at least first and second axial retention fasteners at the first and second rim portions, respectively, the first axial retention fastener configured to fixedly hold one of the first and second dovetail portions of the first and second blades to the first rim portion and the second axial retention fastener configured to fixedly hold the other of the first and second dovetail portions to the second rim portion, wherein the at least first and second axial retention fasteners comprise deformations of at least a portion of the first and second rim portions, respectively.

2. The rotor of claim 1, further comprising an annular seal extending between the first rotor portion and the second rotor portion.

3. The rotor of claim 2, wherein the first and second rotor portions have first and second annular notches, respectively, configured to receive the annular seal.

4. The rotor of claim 2, wherein the annular seal includes an anti-rotational detent member extending therefrom, the first rotor portion having an aperture configured to receive the anti-rotational detent member for synchronizing rotation of the annular seal and the first rotor portion.

5. The rotor of claim 1, wherein the first and second blades and the first and second dovetail portions each have respective chordal lengths that are shorter than the lengths of the first and second rim portions, respectively, as measured along correspondingly oriented dimensions.

6. The rotor of claim 5, wherein respective lead and trailing edges of the first and second blades and the first and second dovetail portions are axially recessed from lead and trailing edges of the first and second rim portions, respectively.

7. A method for replacing a rotor blade of a rotor having at least first and second rotor portions having first and second rim portions, respectively, comprising:

moving a first dovetail portion of a first blade from one of a first dovetail slot and a second dovetail slot defined in the first and second rim portions, respectively, through a perimetrical slot and away from the rotor such that the first blade is removed from the rotor, the perimetrical slot disposed between the first and second rim portions and communicating with the first and second dovetail slots and the first and second rim portions having respective lengths that are substantially similar to respective widths of the at least first and second rotor portions, respectively;

moving a first replacement dovetail portion of a first replacement blade through the perimetrical slot toward one of the first and second rim portions such that the first replacement dovetail portion is received in one of the first and second dovetail slots;

forming at least first and second axial retention fasteners at the first and second rim portions, respectively, the first axial retention fastener including a deformation of the first rim portion that is configured to fixedly hold one of the first and second dovetail portions of the first and second blades to the first rim portion and the second axial retention fastener including a deformation of the second rim portion that is configured to fixedly hold the other of the first and second dovetail portions to the second rim portion.

8. The method of claim 7, further comprising removing at least the first axial retention fastener.

9. The method of claim 7, further comprising forming at least a first replacement axial retention fastener.

10. The method of claim 7, further comprising moving a second dovetail portion of a second blade from the other of the first and second dovetail slots through the perimetrical slot and away from the rotor such that the second blade is removed from the rotor, and moving a second replacement dovetail portion of a second replacement blade through the perimetrical slot toward the other of the first and second rim portions such that the second replacement dovetail portion is received in the other of the first and second dovetail slots.

11. The method of claim 10, further comprising removing at least the second axial retention fastener.

12. The method of claim 10, further comprising forming at least a second replacement axial retention fastener.

* * * * *